US011251560B2

(12) United States Patent
Fernandes

(10) Patent No.: US 11,251,560 B2
(45) Date of Patent: Feb. 15, 2022

(54) TERMINAL POSITION ASSURANCE MEMBER WITH MULTIPLE LATCHES

(71) Applicant: TE CONNECTIVITY CORPORATION, Berwyn, PA (US)

(72) Inventor: Stanrich Dwayne Fernandes, Harrisburg, PA (US)

(73) Assignee: TE Connectivity Services GmbH, Schaffhausen (CH)

( * ) Notice: Subject to any disclaimer, the term of this patent is extended or adjusted under 35 U.S.C. 154(b) by 0 days.

(21) Appl. No.: 16/297,810

(22) Filed: Mar. 11, 2019

(65) Prior Publication Data

US 2020/0295494 A1 Sep. 17, 2020

(51) Int. Cl.

| | |
|---|---|
| ***H01R 13/436*** | (2006.01) |
| ***H01R 13/506*** | (2006.01) |
| ***H01R 13/627*** | (2006.01) |
| ***H01R 13/629*** | (2006.01) |
| ***H01R 13/639*** | (2006.01) |
| ***H01R 13/64*** | (2006.01) |

(52) U.S. Cl.

CPC ..... *H01R 13/436* (2013.01); *H01R 13/506* (2013.01); *H01R 13/629* (2013.01); *H01R 13/6271* (2013.01); *H01R 13/639* (2013.01); *H01R 13/64* (2013.01)

(58) Field of Classification Search

CPC ..... H01R 13/506; H01R 13/436; H01R 13/6271; H01R 13/629

USPC ..... 439/352

See application file for complete search history.

(56) References Cited

U.S. PATENT DOCUMENTS

| | | | | |
|---|---|---|---|---|
| 5,520,553 | A | 5/1996 | Cecil, Jr. et al. | |
| 5,591,041 | A * | 1/1997 | Cecil, Jr. | H01R 13/639 439/352 |
| 6,045,388 | A * | 4/2000 | Higgins | H01R 13/6273 439/352 |
| 6,126,480 | A * | 10/2000 | Kawase | H01R 13/6272 439/352 |
| 6,383,009 | B2 * | 5/2002 | Kawase | H01R 13/6272 439/352 |

(Continued)

FOREIGN PATENT DOCUMENTS

| | | |
|---|---|---|
| EP | 0519815 A1 | 12/1992 |
| FR | 2699012 A1 | 6/1994 |

OTHER PUBLICATIONS

European Search Report issued for EP Appln No. 20161885.7 dated Aug. 6, 2020.

*Primary Examiner* — Marcus E Harcum

(57) ABSTRACT

A terminal position assurance member for use with an electrical connector. The terminal position assurance member includes a terminal engagement section with terminal engaging projections. At least one first latch arm extends from the terminal engagement section. At least one second latch arm extends from the terminal engagement section and is spaced from the at least one first latch arm. The at least one first latch arm engages a portion of a first electrical connector to secure the terminal position assurance member to the first electrical connector when terminals of the first electrical connector are properly positioned. Alternatively, the at least one second latch arm engages a portion of a second electrical connector to secure the terminal position assurance member to the second electrical connector when terminals of the second electrical connector are properly positioned.

17 Claims, 5 Drawing Sheets

(56) References Cited

U.S. PATENT DOCUMENTS 7,326,074 B1 * 2/2008 Lim ..... H01R 13/629 439/352
7,470,138 B1 * 12/2008 Chen ..... H01R 13/506 439/352
7,479,025 B2 * 1/2009 Lee ..... H01R 13/6277 439/349
7,682,181 B1 * 3/2010 Jones, Jr. ..... H01R 13/6272 439/352
8,016,606 B1 * 9/2011 Kwan ..... H01R 13/641 439/352
8,968,021 B1 * 3/2015 Kennedy ..... H01R 13/6273 439/352
9,478,906 B2 * 10/2016 Myer ..... H01R 13/6273
10,038,278 B2 * 7/2018 Lane ..... H01R 13/6272
10,454,199 B1 * 10/2019 Christiano ..... H01R 13/73
2001/0005648 A1 * 6/2001 Kurimoto ..... H01R 13/6272 439/358
2006/0057880 A1 * 3/2006 Miksche ..... H01R 13/6273 439/352
2006/0154510 A1 * 7/2006 Annecke ..... H01R 13/6273 439/352
2007/0049101 A1 3/2007 Onoda et al.
2009/0035981 A1 * 2/2009 Lim ..... H01R 13/4361 439/352
2009/0170362 A1 * 7/2009 Nakamura ..... H01R 13/6272 439/352
2014/0004732 A1 * 1/2014 Heil ..... H01R 13/6275 439/352
2017/0271814 A1 * 9/2017 Salgado ..... H01R 13/6272
2019/0067875 A1 * 2/2019 Ohfuku ..... H01R 13/641

* cited by examiner

TERMINAL POSITION ASSURANCE MEMBER WITH MULTIPLE LATCHES

FIELD OF THE INVENTION

The present invention is directed to a terminal position assurance member. In particular, the invention is directed to a terminal position assurance member with multiple latches to allow the terminal position assurance member to be used with different connector housings.

BACKGROUND OF THE INVENTION

Various electrical connectors are designed for multi-pin connections. The electrical connectors may be mated to mating connectors terminated to wires or mounted on circuit boards. Such multi-pin connectors are generally assembled by coupling terminals to wires, then loading the terminals into terminal receiving cavities in a connector housing. Generally, there are retention features on the terminals and/or in the cavities that are engaged once the terminals reach a designated position within the length of the cavities in order to prevent the terminals from backing out of the cavities unintentionally during use of the connector. Sometimes the retention features fail to prevent the terminals from exiting the cavities, such as if the retention features are dysfunctional or the terminals were not inserted far enough into the cavities to properly engage the retention features. If a respective terminal is not properly retained within a cavity, when the electrical connector is mated to a mating connector, a corresponding mating terminal may not connect properly to the subject terminal. For example, the incoming mating terminal may drive the terminal back out of the housing, preventing a proper electrical connection between the terminal and the mating terminal. While many terminals may be positioned in the housing of the connector, even a single missed electrical connection may compromise the functionality of the entire connector system and the devices they connect.

Electrical connectors in the art have attempted to prevent terminals from unintentional movement in the cavities by adding a restraining device or terminal position assurance device. For example, a device may be added to a rear of the housing that is configured to act as a barrier and/or push any terminals that are not at the designated position further into the respective cavities towards the designated position. Often such terminal position assurance members are a separate member which is inserted into a connector housing in the direction of insertion of the terminals into the cavities to prevent withdrawal of the electrical terminals disposed in the terminal cavities. While known terminal position assurance members are beneficial, a different configuration of the terminal position assurance members is required for each differently configured housing, thereby resulting in many different part numbers and many molds being required for the manufacture of the terminal position assurance members.

It would, therefore, be beneficial to provide a terminal position assurance member with multiple latches to allow the terminal position assurance member to be used with different connector housings, thereby reducing manufacturing and inventory costs.

SUMMARY OF THE INVENTION

An embodiment is directed to a terminal position assurance member for use with an electrical connector. The terminal position assurance member includes a terminal engagement section with terminal engaging projections. At least one first latch arm extends from the terminal engagement section. At least one second latch arm extends from the terminal engagement section and is spaced from the at least one first latch arm. The at least one first latch arm engages a portion of a first electrical connector to secure the terminal position assurance member to the first electrical connector when terminals of the first electrical connector are properly positioned. Alternatively, the at least one second latch arm engages a portion of a second electrical connector to secure the terminal position assurance member to the second electrical connector when terminals of the second electrical connector are properly positioned.

An embodiment is directed to a terminal position assurance member for use with an electrical connector. The terminal position assurance member includes a terminal engagement section. At least one first latch arm extends from the terminal engagement section. At least one second latch arm extends from the terminal engagement section and is spaced from the at least one first latch arm. The at least one first latch arm has a first length and the at least one second latch arm has a second length. The second length is greater than the first length. The at least one first latch arm engages a portion of a first electrical connector to secure the terminal position assurance member to the first electrical connector when terminals of the first electrical connector are properly positioned. Alternatively, the at least one second latch arm engages a portion of a second electrical connector to secure the terminal position assurance member to the second electrical connector when terminals of the second electrical connector are properly positioned.

An embodiment is directed to a terminal position assurance member for use with an electrical connector. The terminal position assurance member includes a terminal engagement section. A pair of first latch arms extend from the terminal engagement section. The first latch arms having lead-in surfaces and locking shoulders. At least one second latch arm extends from the terminal engagement section. The at least one second latch arm has a lead-in surfaces and a locking shoulder. The first latch arms have a first length and the at least one second latch arm have a second length, the second length being greater than the first length.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
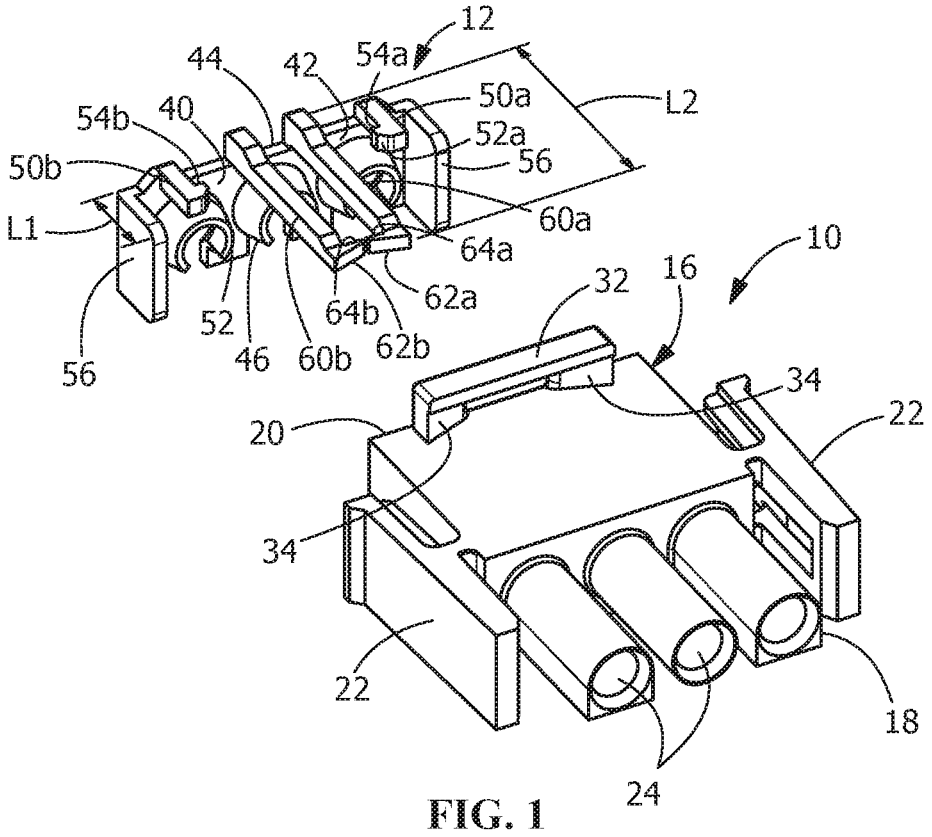
FIG. 1 is a perspective view of an illustrative receptacle connector with an illustrative terminal position assurance member of the present invention exploded therefrom.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Referring to FIG. 1 an electrical connector 10 and a terminal position assurance member 12 are shown spaced apart. In the illustrative embodiment shown, the electrical connector 10 is a receptacle connector. Alternatively, the electrical connector 10 may be a plug connector.

The electrical connector 10 has a housing 16 with a front 18 and a rear 20. The front 18 of the housing 16 is configured to interface with a mating connector. The housing 16 may also include one or more coupling features 22 that allow the housing 16 to couple to the mating connector (not shown). For example, the coupling features 22 may include one or more latches, latch-receiving grooves or projections, and the like.

The housing 16 of the electrical connector 10 has a plurality of terminal receiving cavities 24 for receiving terminals 26 (FIG. 3) therein. The terminal receiving cavities 24 may extend from the rear 20 to the front 18 of the housing 16. The terminal receiving cavities 24 may be oriented between the rear 20 and the front 18 of the housing 16 parallel to each other.

In the illustrative embodiment shown, the housing 16 has three terminal receiving cavities 24. The terminals 26 may be configured to physically and electrically connect to corresponding mating terminals of the mating connector. The particular configuration of the terminals 26 may vary without departing from the scope of the invention.

The terminals 26 have a wire termination end 28 which are terminated by crimping, soldering, insulation displacement and the like, to wires or cables 30 which extend from the rear 20 of the housing 16. The plurality of terminals 26 may be used to transmit power, data, and/or control signals. If a single terminal 26 of the electrical connector 10 fails to correctly engage the corresponding mating terminal of the mating connector, the signal path between those two terminals may be damaged. Furthermore, the broken signal path may also disrupt other signal paths along different terminals in the connector 10.

Figure 2:
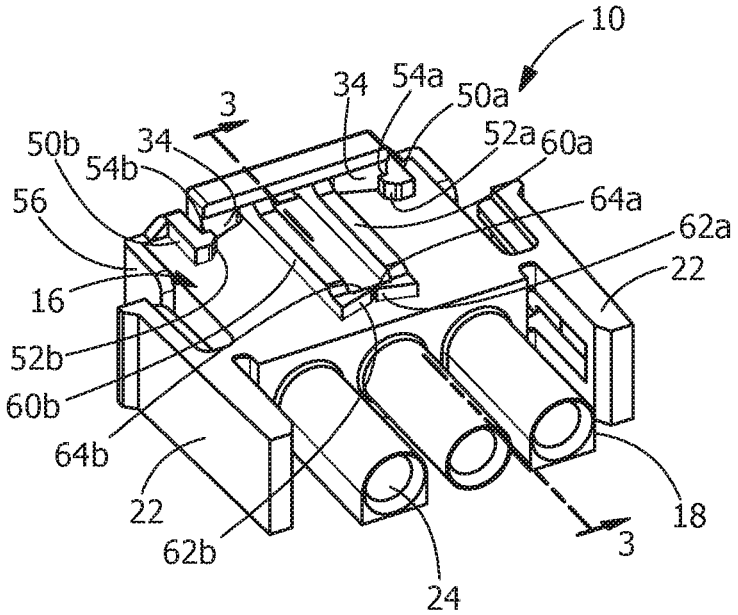
FIG. 2 is a perspective view of the terminal position assurance member of FIG. 1 mated with the receptacle connector.

As best shown in FIGS. 1 and 2, a securing projection 32 extends from the housing 16 of the connector 10. The securing projection 32 has mounting portions 34 which integrally secures the securing projection 32 to the housing 116.

Figure 3:
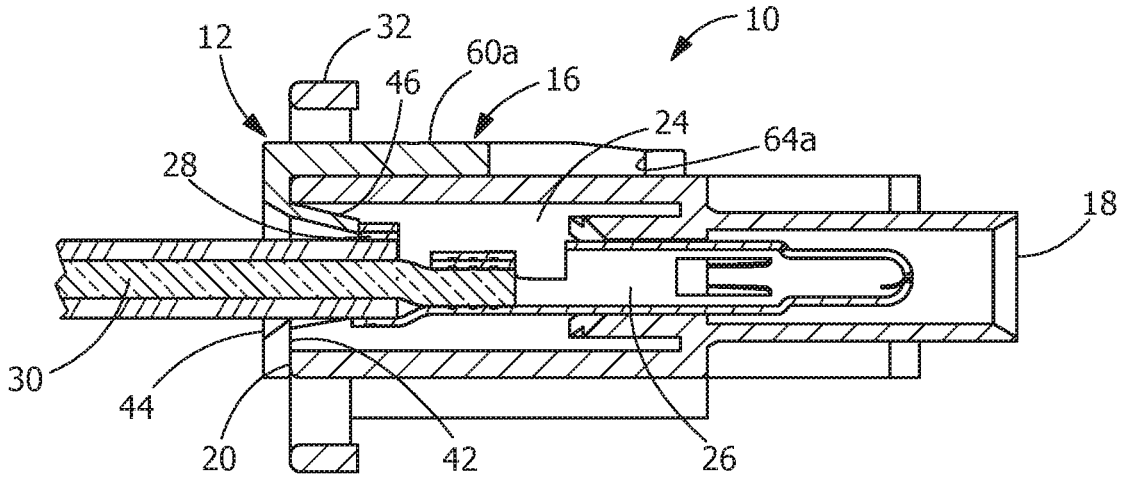
FIG. 3 is a cross-sectional view taken along line 3-3 of FIG. 2.

As is best shown in FIGS. 1 and 3, the terminal position assurance member 12 has a terminal engagement section 40 having a first surface 42 and a second surface 44. The terminal position assurance member 12 may be composed of a non-conductive, insulator material, such as, but not limited to, rubber, plastic and/or a thermoplastic polymer.

Terminal engaging projections 46 extend from the first surface 42 in a direction away from the second surface 44. The terminal engaging projections 46 are configured to be positioned in the terminal receiving cavities 24 to ensure that the terminals 26 are properly positioned.

First latch arms 50*a*, 50*b* extend from the terminal engagement section 40 in a direction away from the second surface 44. The first latch arms 50*a*, 50*b* have lead-in surfaces 52 and locking shoulders 54. The first latch arms 50*a*, 50*b* have a length L1. In the illustrative embodiment shown, a pair of first latch arms 50*a*, 50*b* are provided proximate side surfaces 56 of the terminal position assurance member 12. The locking shoulder 54*a* of the first latch arm 50*a* faces inward toward the first latch arm 50*b*. The locking shoulder 54*b* of the first latch arm 50*b* faces inward toward the first latch arm 50*a*.

Second latch arms 60*a*, 60*b* extend from the terminal engagement section 40 in a direction away from the second surface 44. The second latch arms 60*a*, 60*b* have lead-in surfaces 62 and locking shoulders 64. The second latch arms 60*a*, 60*b* have a length L2. The length L2 of the second latch arms 60*a*, 60*b* is longer than the length L1 of the first latch arms 50*a*, 50*b*. In the illustrative embodiment shown, a pair of second latch arms 60*a*, 60*b* are provided spaced from the side surfaces 56 of the terminal position assurance member 12, such that the second latch arms 60*a*, 60*b* are positioned between the first latch arms 50*a*, 50*b*. The locking shoulder 64*a* of the second latch arms 60*a* faces inward toward the second latch arm 60*b*. The locking shoulder 64*b* of the second latch arm 60*b* faces inward toward the second latch arm 60*a*.

In the embodiment shown in FIGS. 1 through 3, as the terminal position assurance member 12 is moved into engagement with the housing 16, the terminal engaging projections 46 are positioned in the terminal receiving cavities 24 and facilitate the proper position of the terminals 26 in the terminal receiving cavities 24, as is known in the art. As this occurs, the lead-in surfaces 52 of the first latch arms 50*a*, 50*b* engage mounting portions 34 of the securing projection 32, causing the first latch arms 50*a*, 50*b* to resiliently deform. With continued insertion, the locking shoulders 54 move past the mounting portions 34 to allow the first latch arms 50*a*, 50*b* to return toward their unstressed position, thereby securing the terminal position assurance member 12 to the housing 16.

If the terminals 26 are not properly seated in the terminal receiving passages 24, the terminal position assurance member 12 will not be properly positioned in the housing 16. If the terminals 26 are not properly seated in the terminal receiving passages 24, the first latch arms 50*a*, 50*b* are prevented from being secured to the securing projection 32, thereby providing a visual indication that the terminals are not properly positioned.

Figure 4:
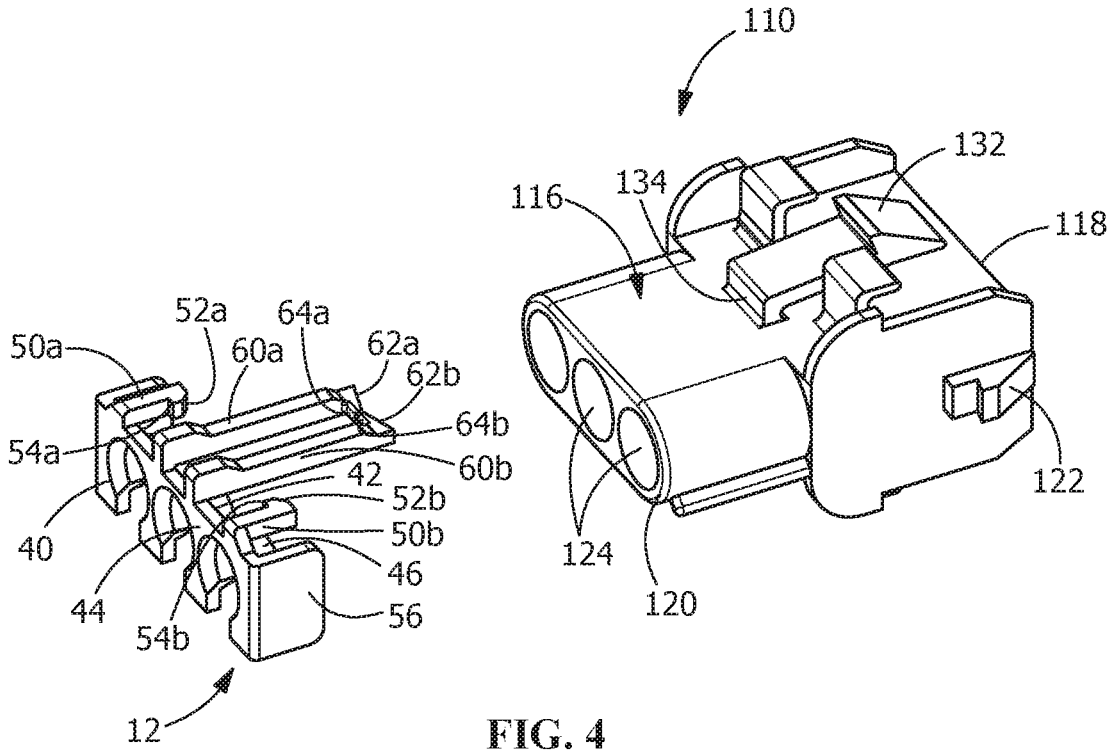
FIG. 4 is a perspective view of the terminal position assurance member of FIG. 1 exploded from a plug connector.

Referring to FIG. 4 an electrical connector 110 and the terminal position assurance member 12 are shown spaced apart. In the illustrative embodiment shown, the electrical connector 110 is a plug connector. Alternatively, the electrical connector 110 may be a receptacle connector.

The electrical connector 110 has a housing 116 with a front 118 and a rear 120. The front 118 of the housing 116 is configured to interface with a mating connector. The housing 116 may also include one or more coupling features 122 that allow the housing 16 to couple to the mating connector (not shown). For example, the coupling features 122 may include one or more latches, latch-receiving grooves or projections, and the like.

The housing 116 of the electrical connector 112 has a plurality of terminal receiving cavities 124 for receiving terminals therein. In the illustrative embodiment shown, the housing 116 has three terminal receiving cavities 124. The terminals are similar to the terminals previously described.

Figure 5:
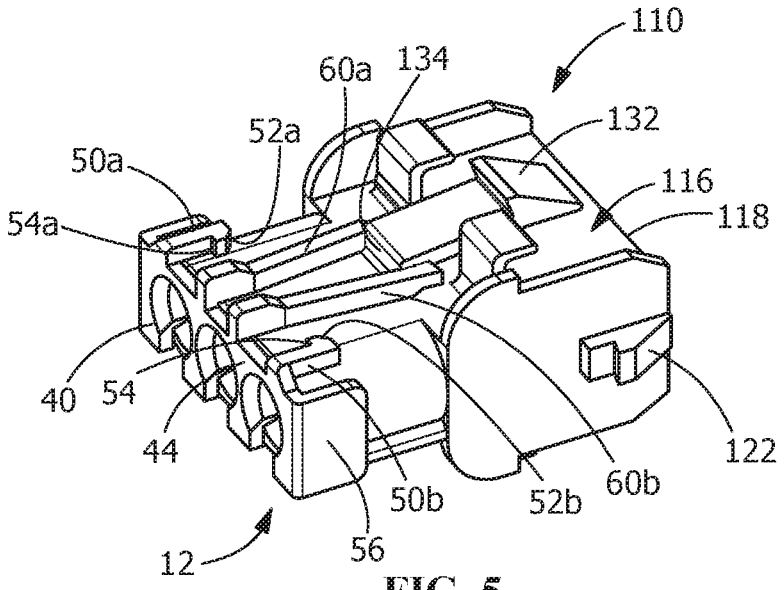
FIG. 5 is a perspective view the terminal position assurance member of FIG. 1 mated with the plug connector.

As best shown in FIGS. 4 and 5, a latch 132 extends from the housing 116 of the connector 110. The latch 132 is used to secure the connector in a panel (not shown) or the like. The latch 132 has a front mounting portion 134 which integrally secures the latch 132 to the housing 116.

In the embodiment shown in FIGS. 4 and 5, as the terminal position assurance member 12 is moved into engagement with the housing 116, the terminal engaging projections 46 are positioned in the terminal receiving cavities 24 and facilitate the proper position of the terminals in the terminal receiving cavities 24, as is known in the art. As this occurs, the lead-in surfaces 62 of the second latch arms 60*a*, 60*b* engage mounting portion 134 of the latch 132, causing the second latch arms 60*a*, 60*b* to resiliently deform. With continued insertion, the locking shoulders 64 move past the mounting portion 134 to allow the second latch arms 60*a*, 60*b* to return toward their unstressed position, thereby securing the terminal position assurance member 12 to the housing 116.

If the terminals are not properly seated in the terminal receiving passages 124, the terminal position assurance member 12 will not be properly positioned in the housing 116. If the terminals are not properly seated in the terminal receiving passages 124, the second latch arms 60*a*, 60*b* are prevented from being secured to the latch 132, thereby providing a visual indication that the terminals are not properly positioned.

Figure 6:
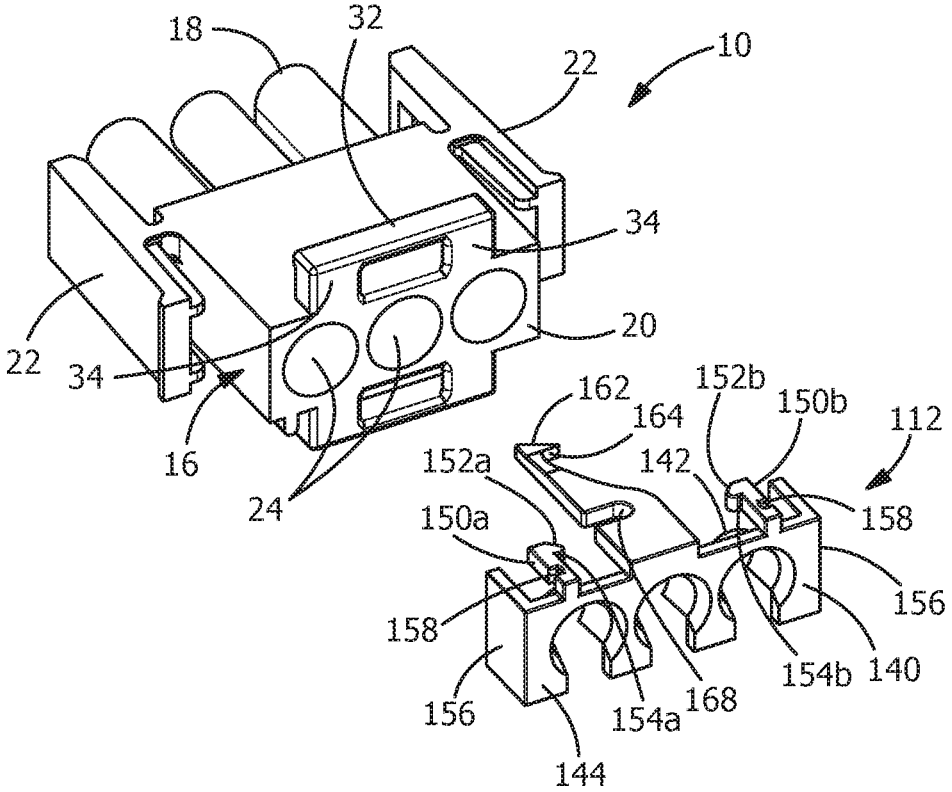
FIG. 6 is a perspective view of the illustrative receptacle connector with an alternate illustrative terminal position assurance member of the present invention exploded therefrom.
Figure 7:
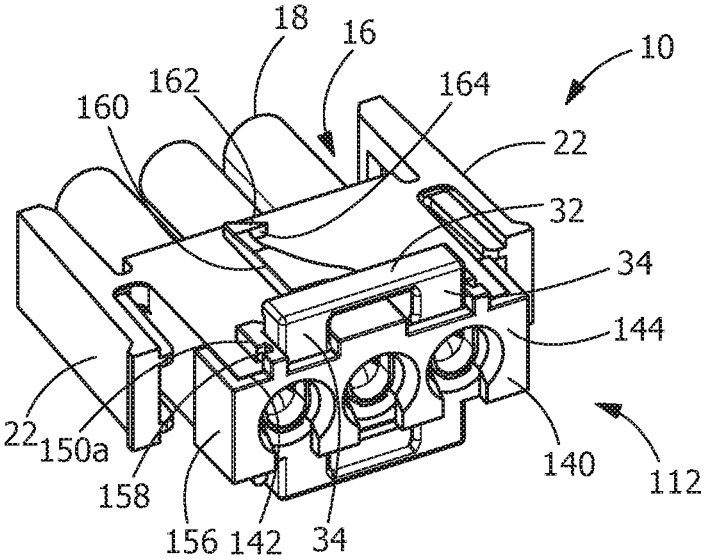
FIG. 7 is a perspective view of the terminal position assurance member of FIG. 6 mated with the receptacle connector.

Referring to FIGS. 6 and 7 the electrical connector 10 and a terminal position assurance member 112 are shown spaced apart. In the illustrative embodiment shown, the electrical connector 10 is a receptacle connector. Alternatively, the electrical connector 10 may be a plug connector.

The terminal position assurance member 112 has a terminal engagement section 140 having a first surface 142 and a second surface 144. The terminal position assurance member 112 may be composed of a non-conductive, insulator material, such as, but not limited to, rubber, plastic and/or a thermoplastic polymer.

Terminal engaging projections 146 extend from the first surface 142 in a direction away from the second surface 144. The terminal engaging projections 146 are configured to be positioned in the terminal receiving cavities 24 to ensure that the terminals are properly positioned.

First latch arms 150*a*, 150*b* extend from the terminal engagement section 140 in a direction away from the second surface 144. The first latch arms 150*a*, 150*b* have lead-in surfaces 152 and locking shoulders 154. The first latch arms 150*a*, 150*b* have a length L1. In the illustrative embodiment shown, a pair of first latch arms 150*a*, 150*b* are provided proximate side surfaces 156 of the terminal position assurance member 112. The locking shoulder 154*a* of the first latch arm 150*a* faces inward toward the first latch arm 150*b*. The locking shoulder 154*b* of the first latch arm 150*b* faces inward toward the first latch arm 150*a*. Recesses 158 may be provided in the first latch arms 150*a*, 150*b*. The recesses 158 are configured to provide increased resiliency or flexibility to the first latch arms 150*a*, 150*b*.

A second latch arm 160 extend from the terminal engagement section 140 in a direction away from the second surface 144. The second latch arm 60 has a lead-in surfaces 162 and a locking shoulder 164. The second latch arm 160 has a length L2. The length L2 of the second latch arm 160 is longer than the length L1 of the first latch arms 150*a*, 150*b*. In the illustrative embodiment shown, the second latch arm 160 is provided spaced from the side surfaces 156 of the terminal position assurance member 112, such that the second latch arm 160 is positioned between the first latch arms 150*a*, 150*b*. A recess 168 may be provided in the second latch arm 160. The recess 160 is configured to provide increased resiliency or flexibility to the second latch arm 160.

As the terminal position assurance member 112 is moved into engagement with the housing 16, the terminal engaging projections 146 are positioned in the terminal receiving cavities 24 and facilitate the proper position of the terminals in the terminal receiving cavities 24, as is known in the art. As this occurs, the lead-in surfaces 152 of the first latch arms 150*a*, 150*b* engage mounting portions 34 of the securing projection 32, causing the first latch arms 150*a*, 150*b* to resiliently deform. With continued insertion, the locking shoulders 154 move past the mounting portions 34 to allow the first latch arms 150*a*, 150*b* to return toward their unstressed position, thereby securing the terminal position assurance member 112 to the housing 16.

If the terminals are not properly seated in the terminal receiving passages 24, the terminal position assurance member 112 will not be properly positioned in the housing 16. If the terminals are not properly seated in the terminal receiving passages 24, the first latch arms 150*a*, 150*b* are prevented from being secured to the securing projection 32, thereby providing a visual indication that the terminals are not properly positioned.

Figure 8:
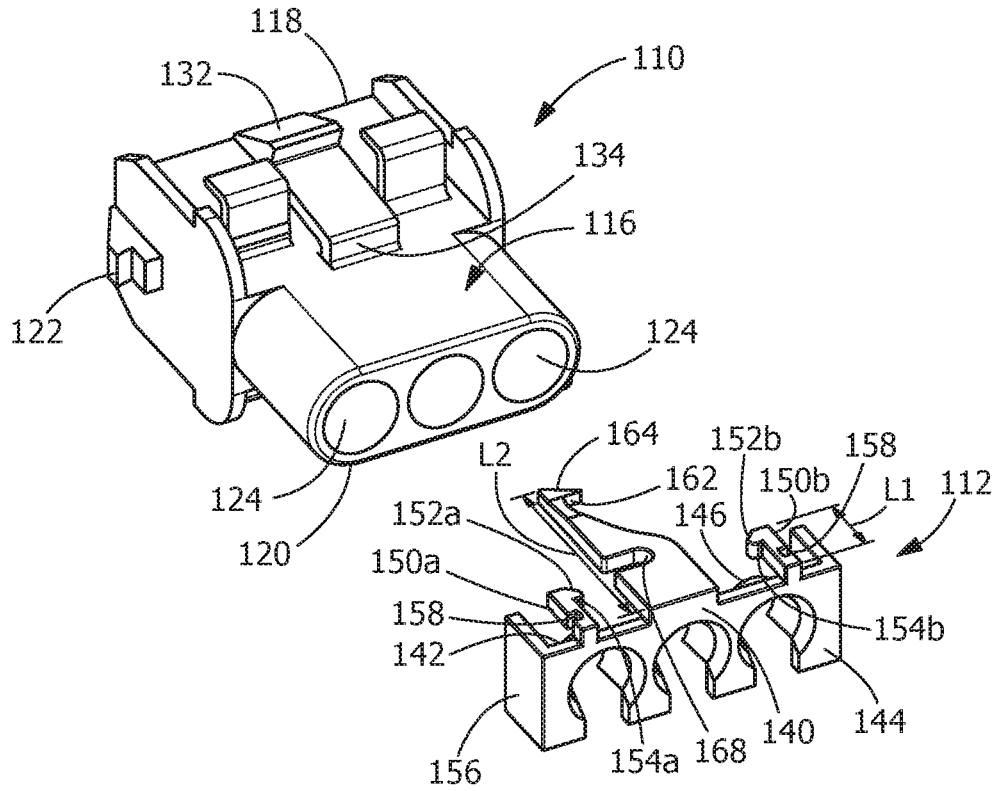
FIG. 8 is a perspective view of the terminal position assurance member of FIG. 6 exploded from the plug connector.

Referring to FIG. 8 the electrical connector 110 and the terminal position assurance member 112 are shown spaced apart. In the illustrative embodiment shown, the electrical connector 110 is a plug connector. Alternatively, the electrical connector 110 may be a receptacle connector.

Figure 9:
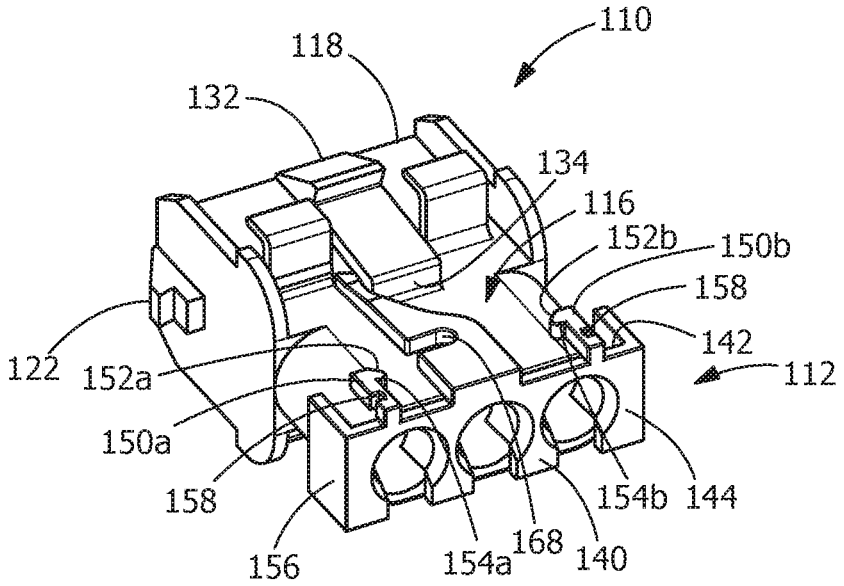
FIG. 9 is a perspective view the terminal position assurance member of FIG. 6 mated with the plug connector.

In the embodiment shown in FIGS. 8 and 9, as the terminal position assurance member 112 is moved into engagement with the housing 116, the terminal engaging projections 146 are positioned in the terminal receiving cavities 124 and facilitate the proper position of the terminals in the terminal receiving cavities 124, as is known in the art. As this occurs, the lead-in surface 162 of the second latch arm 160 engages the mounting portion 134 of the latch 132, causing the second latch arm 160 to resiliently deform. With continued insertion, the locking shoulder 164 moves past the mounting portion 134 to allow the second latch arm 60 to return toward its unstressed position, thereby securing the terminal position assurance member 112 to the housing 116.

If the terminals are not properly seated in the terminal receiving passages 124, the terminal position assurance member 112 will not be properly positioned in the housing 116. If the terminals are not properly seated in the terminal receiving passages 124, the second latch arm 160 is prevented from being secured to the latch 132, thereby providing a visual indication that the terminals are not properly positioned.

The terminal position assurance member of the present invention has multiple latches to allow the terminal position assurance member to be used with different connector housings, thereby reducing manufacturing and inventory costs.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A terminal position assurance member for use with an electrical connector, the terminal position assurance member comprising:

a terminal engagement section with terminal engaging projections extending from a first surface of the terminal engagement section in a direction away from a second surface of the terminal engagement section;

at least one first latch arm extending from the terminal engagement section in a direction away from the second surface of the terminal engagement section, the at least one first latch arm having a first length;

at least one second latch arm extending from the terminal engagement section in a direction away from the second surface of the terminal engagement section, the at least one second latch arm spaced from the at least one first latch arm, the at least one second latch arm having a second length, the second length of the at least one second latch arm being different from the first length of the at least one first latch arm;

wherein the at least one first latch arm is configured to engage a portion of a first electrical connector to secure the terminal engaging projections of the terminal position assurance member in first terminal receiving cavities of the first electrical connector; and the at least one second latch arm is configured to engage a portion of a second electrical connector to secure the terminal engaging projections of the terminal position assurance member in second terminal receiving cavities of the second electrical connector, the second electrical connector having a different configuration than the first electrical connector.

2. The terminal position assurance member as recited in claim 1, wherein the terminal engagement section has a first surface and a second surface.

3. The terminal position assurance member as recited in claim 2, wherein the terminal engaging projections are configured to be positioned in terminal receiving cavities of the electrical connectors.

4. The terminal position assurance member as recited in claim 2, wherein the at least one first latch arm extends from the terminal engagement section in a direction away from the second surface.

5. The terminal position assurance member as recited in claim 4, wherein the at least one first latch arm has a lead-in surface and a locking shoulder.

6. The terminal position assurance member as recited in claim 5, wherein the at least one first latch arm is a pair of first latch arms proximate side surfaces of the terminal position assurance member, the locking shoulder of one first latch arm of the pair of first latch arms faces inward toward another first latch arm of the pair of first latch arms.

7. The terminal position assurance member as recited in claim 4, wherein the at least one second latch arm extends from the terminal engagement section in a direction away from the second surface.

8. The terminal position assurance member as recited in claim 7, wherein the at least one second latch arm has a lead-in surface and a locking shoulder.

9. The terminal position assurance member as recited in claim 8, wherein the at least one second latch arm is a pair of second latch arms spaced from side surfaces of the terminal position assurance member, the locking shoulder of one second latch arm of the pair of second latch arms faces inward toward another second latch arm of the pair of second latch arms.

10. The terminal position assurance member as recited in claim 1, wherein the at least one first latch arm has a recess to provide increased resiliency or flexibility to the at least one first latch arm.

11. The terminal position assurance member as recited in claim 1, wherein the at least one second latch arm has a recess to provide increased resiliency or flexibility to the at least one second latch arm.

12. The terminal position assurance member as recited in claim 1, wherein the terminal position assurance member is made of a non-conductive, insulator material.

13. A terminal position assurance member for use with an electrical connector, the terminal position assurance member comprising:

a terminal engagement section with terminal engagement projections;

at least one first latch arm extending from the terminal engagement section in the same direction as the terminal engagement projections;

at least one second latch arm extending from the terminal engagement section in the same direction as the terminal engagement projections, the at least one second latch arm spaced from the at least one first latch arm;

the at least one first latch arm having a first length and the at least one second latch arm having a second length, the second length being greater than the first length;

wherein the at least one first latch arm is configured to engage a portion of a first electrical connector to secure terminal engaging projections of the terminal position assurance member in first terminal receiving cavities of the first electrical connector; and the at least one second latch arm is configured to engage a portion of a second electrical connector to secure the terminal engaging projections of the terminal position assurance member in second terminal receiving cavities of the second electrical connector, the second electrical connector having a different configuration than the first electrical connector.

14. The terminal position assurance member as recited in claim 13, wherein the at least one first latch arm has a lead-in surface and a locking shoulder.

15. The terminal position assurance member as recited in claim 14, wherein the at least one first latch arm is a pair of first latch arms proximate side surfaces of the terminal position assurance member, the locking shoulder of one first latch arm of the pair of first latch arms faces inward toward another first latch arm of the pair of first latch arms.

16. The terminal position assurance member as recited in claim 14, wherein the at least one second latch arm has a lead-in surface and a locking shoulder.

17. The terminal position assurance member as recited in claim 16, wherein the at least one second latch arm is a pair of second latch arms spaced from side surfaces of the terminal position assurance member, the locking shoulder of one second latch arm of the pair of second latch arms faces inward toward another second latch arm of the pair of second latch arms.

* * * * *